US005685282A

United States Patent [19]

Murata et al.

[11] Patent Number: 5,685,282

[45] Date of Patent: Nov. 11, 1997

[54] IGNITION DEVICE AND ELECTRICAL CONNECTOR FOR INTERNAL COMBUSTION ENGINE

[75] Inventors: Shigemi Murata; Mitsuru Koiwa, both of Tokyo, Japan

[73] Assignee: Mitsubishi Denki Kabushiki Kaisha, Tokyo, Japan

[21] Appl. No.: 600,280

[22] Filed: Feb. 12, 1996

[30] Foreign Application Priority Data

Mar. 20, 1995 [JP] Japan ..... 7-060525

[51] Int. Cl.[6] ..... F02P 13/00

[52] U.S. Cl. ..... 123/635; 123/169 PA; 439/125

[58] Field of Search ..... 123/635, 647, 123/169 PA, 169 PH; 439/125, 127

[56] References Cited

U.S. PATENT DOCUMENTS

| | | | |
|---|---|---|---|
| 4,944,259 | 7/1990 | Richardson | 123/647 |
| 5,038,745 | 8/1991 | Krappel et al. | 123/635 |
| 5,332,394 | 7/1994 | Frost | 439/125 |
| 5,577,921 | 11/1996 | Philyaw et al. | 123/169 PA |

FOREIGN PATENT DOCUMENTS

| | | | |
|---|---|---|---|
| 3302878 | 8/1984 | Germany | 439/125 |
| 2-115969 | 9/1990 | Japan . | |
| 6-58237 | 3/1994 | Japan . | |

*Primary Examiner*—Andrew M. Dolinar

*Attorney, Agent, or Firm*—Sughrue,Mion,Zinn,Macpeak & Seas, PLLC

[57] ABSTRACT

An ignition device for an internal combustion engine, comprising, a spark plug 7 including a high voltage terminal 8, an ignition coil 1 for generating a high voltage to be supplied to the spark plug, and adapter assembly 19*a* for electrically connecting the ignition coil to the high voltage terminal of the spark plug, said adapter assembly having a support sleeve 20 for accommodating and supporting the high voltage terminal of the spark plug against a transverse movement of the high voltage terminal. The support sleeve may be a continuous extension, a metal tube of the adapter assembly. The assembly may also comprises a wear resisting material which may be an elastic member, a metal member. An electrical connector for use in such ignition device is also disclosed.

16 Claims, 7 Drawing Sheets

IGNITION DEVICE AND ELECTRICAL CONNECTOR FOR INTERNAL COMBUSTION ENGINE

BACKGROUND OF THE INVENTION

This invention relates to an ignition device and an electrical connector for an internal combustion engine and, more particularly, to an ignition device and an electrical connector to be mounted to a cylinder head cover of an internal combustion engine for supplying a high voltage directly to a spark plug.

FIG. 6 illustrates in section a conventional ignition device similar to the one disclosed in Japanese Patent Laid Open No. 6-58237. In the figure, reference numeral 1 is an ignition coil, 2 is a harness to be connected to an external circuit such as a power unit for the ignition coil 1, 3 is a cylinder head cover of an internal combustion engine to which the ignition coil 1 is mounted, and 4 are mounting bolts for attaching the ignition coil 1 to the cylinder head cover 3. Reference numeral 5 is a high voltage terminal for supplying therefrom a high voltage generated by the ignition coil 1, 6 is a high voltage tower of the ignition coil I for providing mechanical connection to the high voltage connecting portion, 7 is a spark plug, 8 is a high voltage terminal of the spark plug 7, and 9 is a rod-shaped conductor for electrically connecting the high voltage terminal 5 of the ignition coil 1 to the high voltage terminal 8 of the spark plug 7. At the opposite ends of the conductor 9, compression springs 10 and 11 are mounted in a slightly compressed state for establishing good electrical contacts against the high voltage terminals 5 and 8. Reference numeral 12 is an adapter insulator made of resin and disposed around the rod conductor 9 for electrically insulating the high voltage conductor 9 against an inner surface of the plug hole wall 13 of the grounded cylinder head. Thus, the rod conductor 9, the electrically conductive springs 10 and 11, and the adapter insulator 12 together constitute an adapter assembly 12*a* for electrically connecting the ignition coil 1 to the high voltage terminal 8 of the spark plug 7.

Reference numeral 15 is a rubber cap which is a first rubber member for mechanically connecting the high voltage tower 6 of the ignition coil 1 and the adapter assembly 12*a* and for preventing ingress of moisture into the plug hole 14, 16 is a rubber cap which is a second rubber member for mechanically connecting the adapter assembly 12*a* to the high voltage terminal 8 of the spark plug 7 and for preventing leakage of the high voltage on the high voltage terminal 8 to the plug hole wall 13. Since the rubber cap 16 is subjected to a much higher temperature as compared to the rubber cap 15, the rubber cap 16 is made of a material exhibiting a good withstand voltage even at an elevated temperature, such as silicone rubber which is very expensive. Reference numeral 17 is a spark gap for generating an electrical spark and 18 is a cam shaft housing section of the internal combustion engine, the height of which corresponds to the depth of the plug hole 14.

When an external circuit (not shown) including a power transistor or a control unit connected to the harness 2 provides an intermittent primary current to the ignition coil 1, the ignition coil 1 generates a high voltage at its high voltage terminal 5. The high voltage generated by the ignition coil 1 is supplied from the high voltage terminal 5 to the high voltage terminal 8 of the spark plug 7 through the spring 10, the conductor 9 and the spring 11 and causes a spark to generate across the spark gap 17, whereby the fuel-air mixture gas within the cylinder is detonated.

★ Such the ignition device can be easily adapted to various internal combustion engines having differing length dimension of the cam shaft housing section 18 by simply replacing the conductor 9 and the adapter 12 only as long as the coil mounting portion has the same configuration. ★

FIG. 7 is a diagram illustrating the vibration system of the conventional ignition device as illustrated in FIG. 6 from which it is understood that the resonance frequency f of the adapter assembly 12*a* can be expressed as $f \alpha \sqrt{(K/m)}$, where K is rigidity of the rubber cap 16 and m is mass of the adapter assembly 12*a*. Since the plug hole 14 of the conventional internal combustion engine is large in diameter and relatively shallow, the rigidity K of the rubber cap 16 may be increased by increasing its thickness, and the mass m is not large because of its relatively short length. Therefore, the resonance frequency f of the vibration system of the ignition device can be set at a high frequency which is very much different from the vibration frequency of the internal combustion engine.

However, the internal combustion engine of the recent years has a cam shaft housing section 8 having a relatively large height dimension in order to accommodate therein various sophisticated components including a number of intake and exhaust valves as well as variable regulating mechanisms for the valve operation. Therefore, the plug hole 14 is narrow and elongated, resulting in an increase of the mass m due to the increase in axial length of the adapter assembly 12*a* and decrease in rigidity K of the rubber cap 16 due to the thinned cap 16, whereby the ignition device has a resonance frequency f that is sufficiently low to become a resonance problem in connection with the vibration of the internal combustion engine.

That is, the resonance of the components of the ignition device takes place due to the vibration of the internal combustion engine. More particularly, the adapter assembly 12*a* significantly oscillates about the high voltage tower 6 of the ignition coil 1 relative to the plug hole wall 13 and the plug 7, causing the oscillating end of the spring 11 to be brought into contact with the high voltage terminal 8 of the spark plug 7 and worn, resulting in a poor electrical connection between these components.

SUMMARY OF THE INVENTION

Accordingly, one object of the present invention is to provide an ignition device for an internal combustion engine free from the above-discussed problems of the conventional ignition device for an internal combustion engine.

Another object of the present invention is to provide an ignition device for an internal combustion engine in which the adapter does not oscillate within the plug hole relative to the plug and generates no wear of the components of the device.

A further object of the present invention is to provide an ignition device for an internal combustion engine in which a good electrical contact is reliably maintained between the components of the ignition device.

Still another object of the present invention is to provide an electrical connector for use in an ignition device for an internal combustion engine which is simple in structure and still rigid enough to prevent resonance vibration.

With the above object in view, the present invention resides in an ignition device for an internal combustion engine which comprises a spark plug including a high voltage terminal and an ignition coil for supplying a high voltage to the spark plug. An adapter assembly for electrically connecting the ignition coil to the high voltage terminal of the spark plug comprises a support sleeve disposed to the adapter assembly for accommodating and supporting the high voltage terminal of the spark plug against a transverse movement of the high voltage terminal. The support sleeve may comprise a continuous extension of the adapter assembly or an electrically conductive metal tube secured at its one end to the adapter assembly.

The adapter assembly may comprise an electrically conductive metal tube extending therein, the metal tube having at its one end the support sleeve as its integral, continuous extension.

The support sleeve may have an inwardly extending projection for establishing an electrical contact with respect to the high voltage terminal of the spark plug, and alternatively, the support sleeve may comprise wear resistive material, such as an elastic member, a metal member or film attached to the inner surface of the sleeve, disposed between the high voltage terminal of the spark plug and an inner surface of the support sleeve, for minimizing wear of the sleeve.

The present invention also resides in an electrical connector for connecting a high voltage terminal of a spark plug of an internal combustion engine to an ignition coil, which comprises a first electrically insulating cap adapted to be attached to the ignition coil, a second electrically insulating cap adapted to be attached to the spark plug, an electrical insulator attached to the first and second electrically insulating caps at its opposite ends, and an electrical conductor supported by and extending through the electrical insulator for electrically connecting the ignition coil and the high voltage terminal of the spark plug to each other. The electrical insulator is provided with a support sleeve disposed thereto for accommodating and supporting the high voltage terminal of the spark plug at its inner surface against a transverse movement of the high voltage terminal.

The electrical conductor may include a conductor rod and a compression spring inserted between the conductor rod and the high voltage terminal of the spark plug. The high voltage terminal of the spark plug and one end of the electrical conductor connected to the high voltage terminal may be accommodated within the support sleeve which is supported within the second electrically insulating cap.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
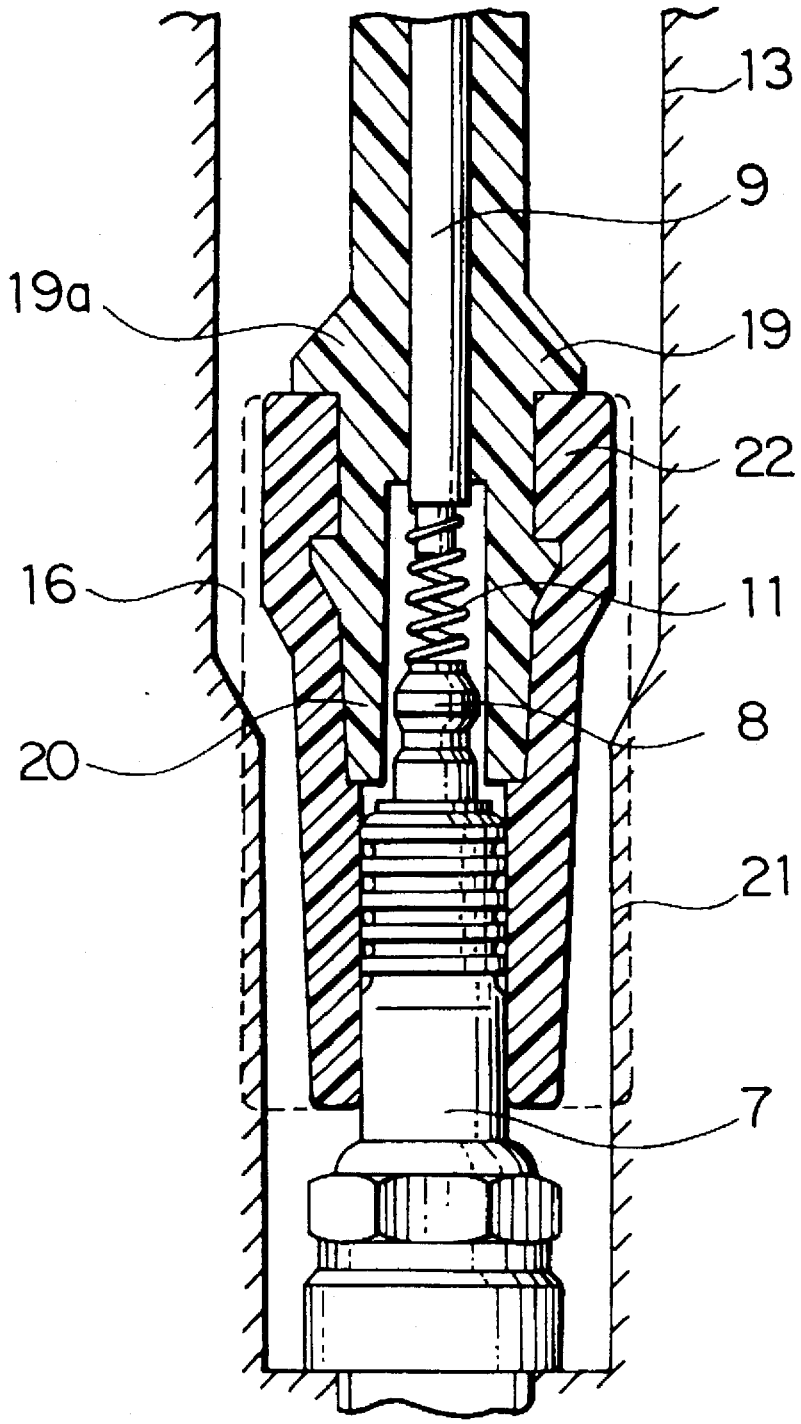
FIG. 1 is a sectional view of the electrical connector of one embodiment of the ignition device of the present invention.

FIG. 1 illustrates an electrical connector of an ignition device for an internal combustion engine of the present invention. While FIG. 1 illustrates only some part of the ignition device, the ignition device of the present invention also comprises an ignition coil, a first rubber cap, a compression spring, etc. similar to those illustrated in FIG. 6.

In FIG. 1, the ignition device of the present invention comprises a spark plug 7 having a high voltage terminal 8 and thread-engaged with the bottom of the plug hole 14. The electrical connector is used for connecting the spark plug 7 to the ignition coil (not shown) similar to the ignition coil 1 shown in FIG. 6 for supplying a high voltage generated by the ignition coil to the spark plug.

In FIG. 1, reference numeral 7 is a spark plug, 8 is a high voltage terminal of the spark plug 7, 9 is a rod-shaped conductor for supplying a high voltage from the high voltage terminal 5 and the high voltage terminal 8, to which an electrically conductive compression springs 10 and 11 are associated at its opposite ends to ensure a good electrical contact with respect to the high voltage terminals 5 and 8. Reference numeral 19 is an adapter insulator disposed around the conductor 9 and made of an electrically insulating resin for electrically insulating the high potential conductor 9 from the internal combustion engine which is at grounded potential. Thus, the rod conductor 9, the electrically conductive springs 10 and 11, and the adapter insulator 19 together constitute an adapter assembly **19*a* for electrically connecting the ignition coil 1 to the high voltage terminal 8 of the spark plug 7**.

According to the present invention, the adapter insulator 19 is provided at its one end with a support sleeve 20 which is a unitary, continuous, hollow axial extension of the adapter insulator 19 for accommodating and supporting therein the high voltage terminal 8 of the spark plug 7. The axial length of the support sleeve 20 is sufficient to receive therein the high voltage terminal 8 of the spark plug 7. The adapter insulator 19 and therefore the support sleeve 20 is made of a thermo-plastic or thermo-setting resin and the high voltage terminal 8 is made of metal, so that it is not desirable that they are in a pressure fit relationship. Therefore, the inner diameter of the support sleeve 20 is determined so that a minimum clearance is generated between the support sleeve 20 and the high voltage terminal 8 when the inner diameter tolerance of the support sleeve 20 is at its lower limit and the outer diameter tolerance of the high voltage terminal 8 is at its upper limit.

Reference numeral 21 is a deep section of the plug hole wall 13, which has a reduced diameter because of the limitation imposed by the mechanism of the internal combustion engine. Reference numeral 22 is a second electrically insulating cap made of silicone rubber for mechanically connecting the adapter assembly **19*a* to the high voltage terminal 8 of the spark plug 7 and for preventing leakage of the high voltage on the high voltage terminal 8 to the plug hole wall 13. It is to be noted that the wall of the second insulating cap 22 is thinner than that of the conventional rubber cap 16** shown in dash line.

In this embodiment, the high voltage terminal 8 of the spark plug 7 is accommodated within the support sleeve 20 of the adapter insulator 19 with a very small gap between the high voltage terminal 8 and the inner peripheral wall of the support sleeve 20. That is, in this state, the high voltage terminal 8 is held by the support sleeve 20.

Therefore, even when the adapter assembly 19*a* is subjected to a vibrating force which otherwise causes the assembly 19*a* to vibrate about the high voltage tower 6, the vibration of the adapter assembly 19*a* is limited to only a very low level because the high voltage terminal 8 of the spark plug 7 is in contact with the support sleeve 20 of the adapter assembly 19*a*.

Therefore, when the deep portion 21 of the plug hole wall 13 is narrowed and only a small inner diameter is provided due to the limitations imposed by the mechanical arrangement of the internal combustion engine and therefore, even when the wall of the rubber cap 22 is thinned and the rigidity K of the rubber cap 22 is decreased, or even when the depth of the cam shaft housing section 18 is increased and the axial length of the adapter assembly 19*a* is accordingly increased and the mass m of the adapter assembly 19*a* is increased, the resonant oscillation of the adapter assembly 19*a* due to the vibration of the internal combustion engine can be physically suppressed.

Thus, since the vibration of the adapter assembly 19*a* relative to the spark plug 7 about the high voltage tower 6 is eliminated, the wearing of the spring 11 due to the rubbing thereof against the high voltage terminal 8 is prevented and a good electrical contact can be maintained.

As previously described, the rubber cap 22 is made generally of silicone rubber which exhibits a very good withstand voltage under an elevated temperature but is very expensive.

It is to be noted that the rubber cap 22 which is the second rubber member is required only to have a thickness sufficient to prevent an electric leakage from the high voltage terminal 8 to the plug hole wall 13 or its deep section 21. However, in the conventional ignition device, the rubber cap 16 is provided with an excess thickness in order to have a required rigidity K which is required to prevent the resonance of the adapter assembly 19*a*.

On the contrary, in the embodiment of the present invention, the adapter assembly 19*a* does not vibrate irrespective of the rigidity K of the rubber cap 22, so that the thickness of the rubber cap 22 which is the second rubber member is may have only a minimum wall thickness which is sufficient to prevent the leakage of the high voltage between the high voltage terminal 8 and the plug hole wall 13 or its deep section 21, whereby the amount of the expensive silicone rubber material needed can be significantly reduced, enabling the ignition device to be miniaturized.

The high voltage terminal 8 of the spark plug 7 is accommodated within the support sleeve 20 of the adapter insulator 19 and they are in direct contact with each other in the above-described embodiment. However, when the material used in the support sleeve 20 is poor in wear resistance, the contact surface of the support sleeve 20 contacting with the high voltage terminal 8 is worn and provides a large inner diameter, disabling the support sleeve 20 to snugly hold the high voltage terminal 8 and limit the undesirable vibration of the adapter assembly 19*a*. Therefore, a buffer may be interposed between the high voltage terminal 8 and the support sleeve 20 for moderating or alleviating the collisions therebetween thereby to prevent the vibration of the adapter assembly 19*a* for a long period of time.

Figure 2:
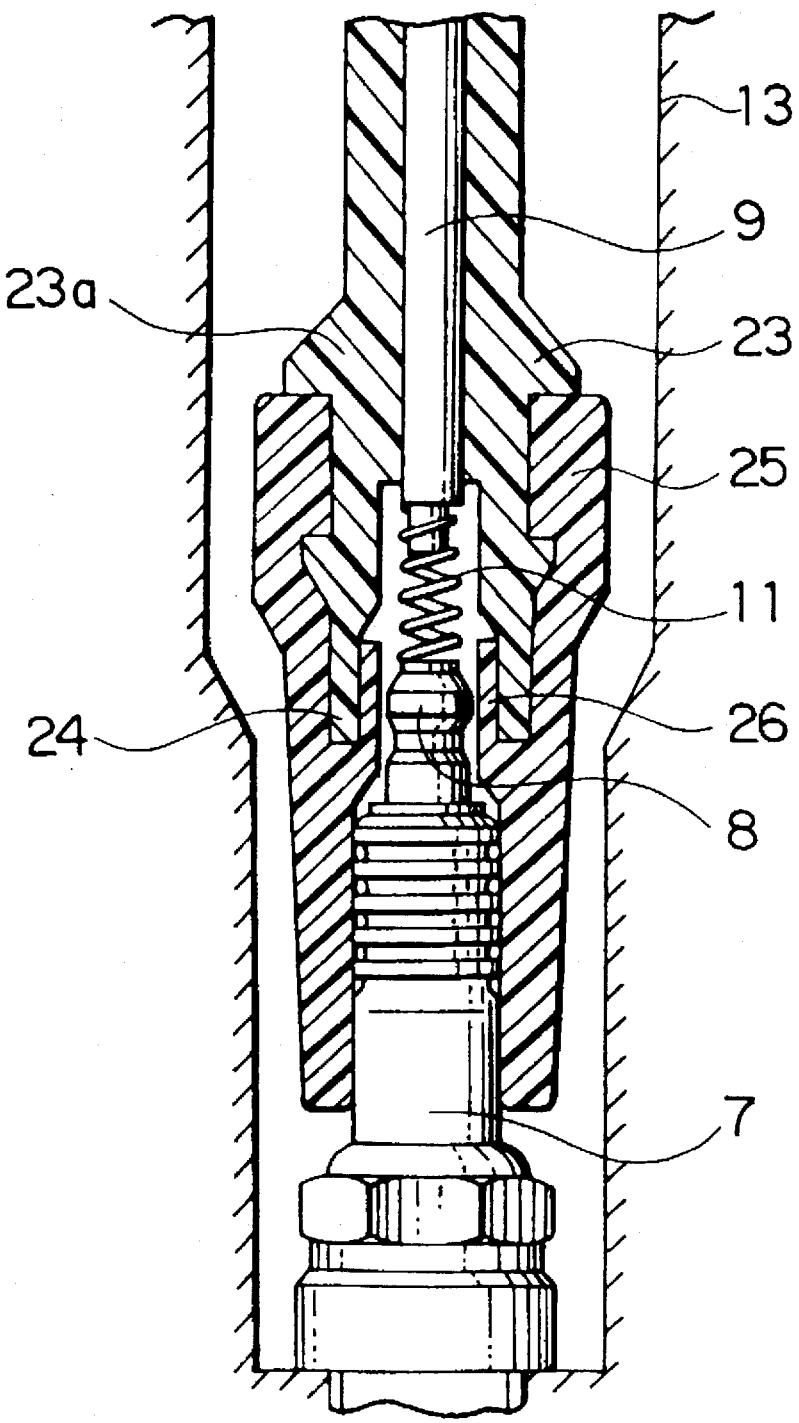
FIG. 2 is a sectional view of the electrical connector of the ignition device of another embodiment of the present invention.

FIG. 2 illustrates another embodiment of the present invention which utilizes such buffer, in which the same reference numerals designate the corresponding or identical components to those previously described. In FIG. 2, reference numeral 23 is an adapter insulator, which is, as in the previous embodiment, extended at one end thereof toward the spark plug 7 to define a support sleeve 24 having an inner diameter larger than that shown in FIG. 1. Reference numeral 25 is a rubber cap which is a second rubber member and has formed therein a cylindrical portion 26 extending so as to be interposed between the high voltage terminal 8 and the support sleeve 24 of the adapter insulator 23 when the high voltage terminal 8 is accommodated within the support sleeve 24. This cylindrical portion 26 constitutes the buffer means for alleviating the collision between the high voltage terminal 8 and the inner wall of the support sleeve 24.

In this embodiment, the support sleeve 24 holds the high voltage terminal 8 through the cylindrical portion 26 of the rubber cap 25. Therefore, even when the ignition device vibrates due to the vibration of the internal combustion engine, the cylindrical buffer 26 moderates the collision between the high voltage terminal 8 and the support sleeve 24 as well as eliminates the frictional contact therebetween to reduce the wearing. Thus, the cylindrical portion 26 may be called as a wearing suppressing means for reducing the wear of the inner wall of the support sleeve 24. Therefore, the wearing due to the rubbing action between the spring 11 and the high voltage terminal 8 can be prevented and a good electrical contact therebetween can be maintained for a prolonged period of time. Also, there is no need to provide a gap between the support sleeve 24 and the cylindrical portion 26 or the cylindrical portion 26 and the high voltage terminal 8. Therefore, the support sleeve 24 can more firmly hold the high voltage terminal 8 through the cylindrical portion 26. This arrangement also allows the vibration of the adapter assembly 23 to be limited to a much lower level.

Figure 3:
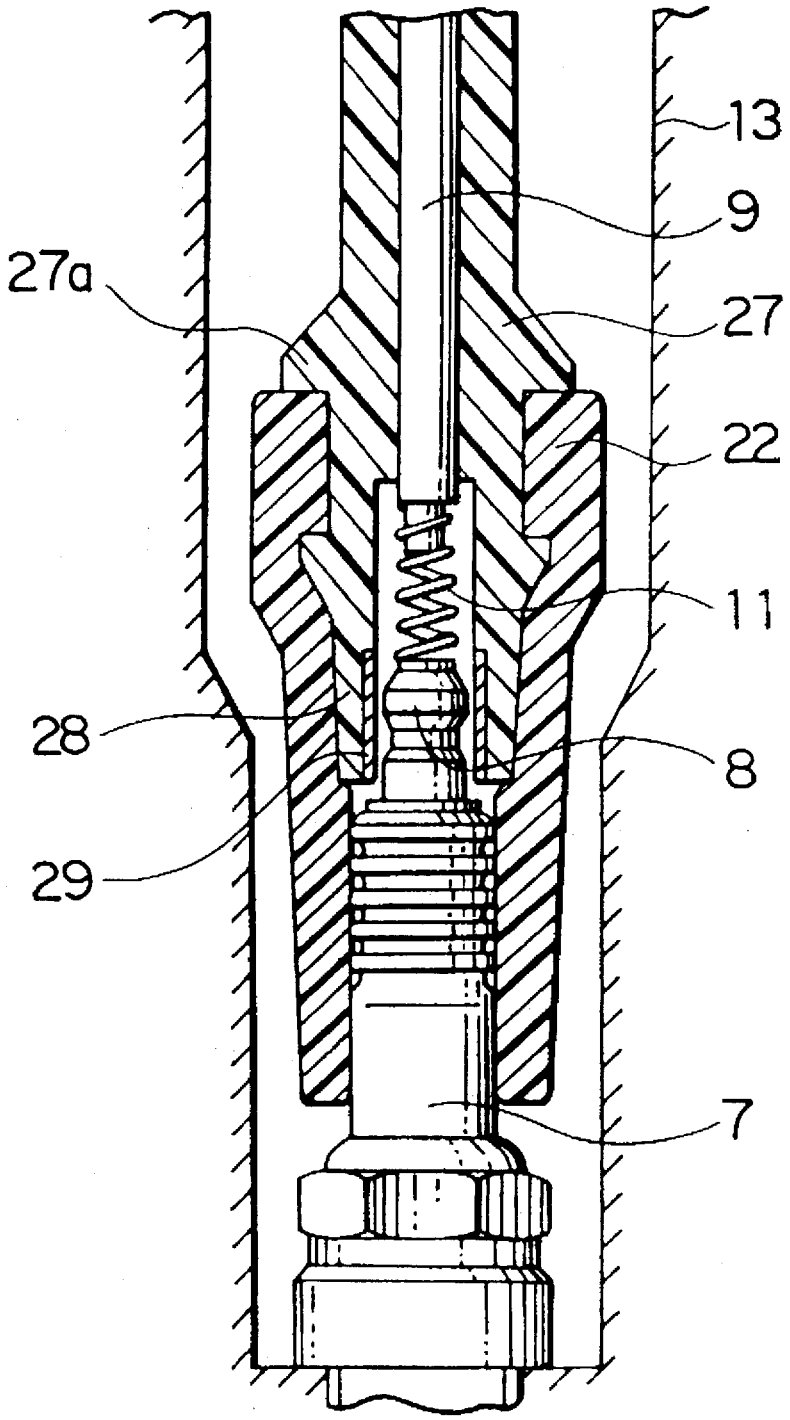
FIG. 3 is a sectional view of the electrical connector of the ignition device of still another embodiment of the present invention.

FIG. 3 illustrates another embodiment of the present invention, in which the same reference numerals designate the corresponding or identical components to those previously described. In FIG. 3, reference numeral 27 is an adapter insulator, 28 is a support sleeve, 29 is a cylindrical member attached to the inner surface of the support sleeve 28. The cylindrical member 29 constitutes the buffer means.

When the adapter insulator 27 is made of a material that has a low resistivity to wear or when the vibration of the internal combustion engine is very severe, the cylindrical member 29 may be made of a material having a high resistivity to wear such as stainless steel and may be attached to the adapter insulator 27 by press-fit, insert molding, etc. It is to be noted that a slight gap similar to that described in conjunction with the embodiment illustrated in FIG. 1 is provided between the high voltage terminal 8 and the inner wall surface of the cylindrical member 29. Thus, this causes the support sleeve 28 to hold the high voltage terminal 8 through the cylindrical member 29, limiting the vibration of the adapter assembly 27*a* and preventing the Wearing of the adapter assembly due to the collision or rubbing.

Figure 4:
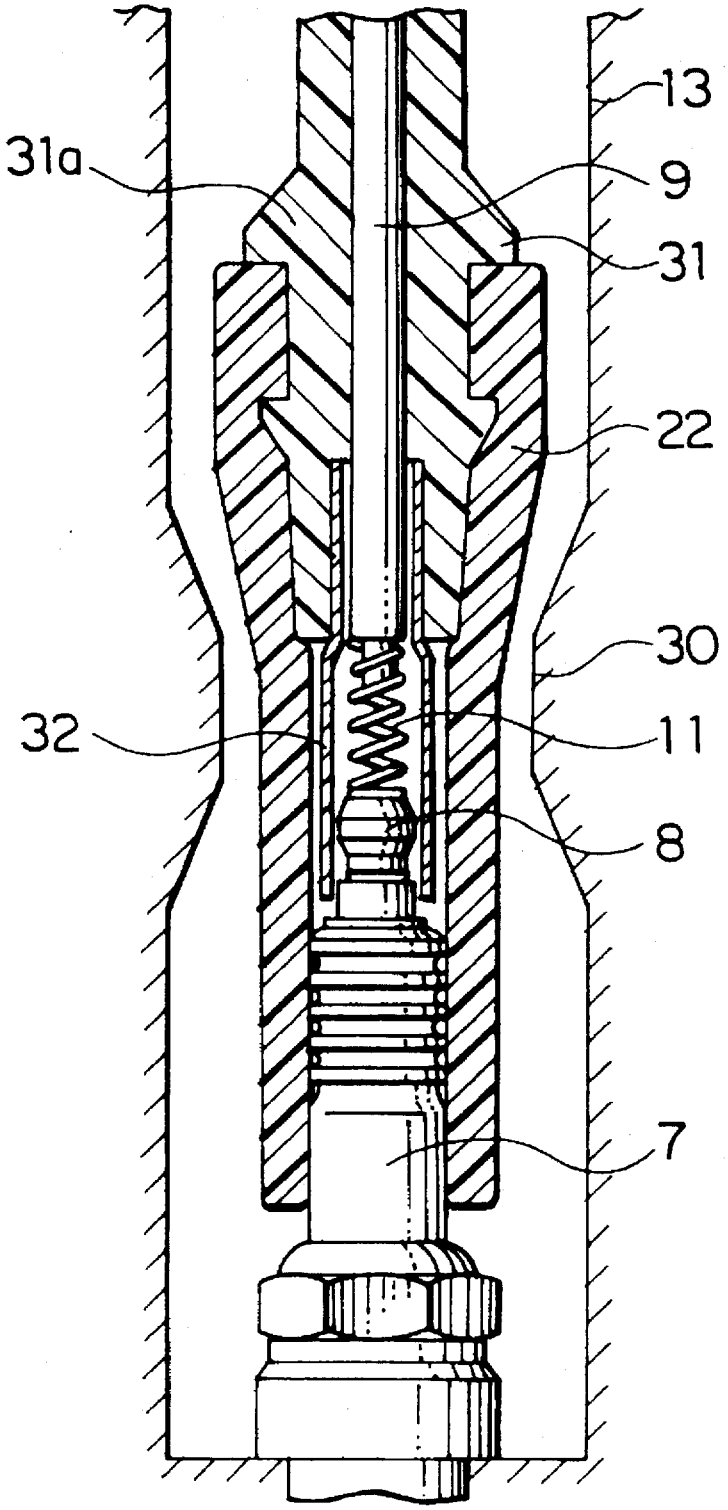
FIG. 4 is a sectional view of the electrical connector of the ignition device of a further embodiment of the present invention.

Instead of the cylindrical member 29, a protective film or layer of a material having a high wear resistivity which constitutes wear suppressing means may be formed on the inner surface of the support sleeve 28 of the adapter insulator 27. The protective film may be made of metal powders, resinous material (polyimide, polyamide, polyamideimide, etc.) formed by baking, painting or vapor-evaporation. Alternatively, a separate protective member made of a suitable metal or resin may be press-fit, bonded, baked or insert-molded into the adapter insulator 27 in place of the protective FIG. 4 illustrates another embodiment which is particularly useful when used in a plug hole 14 with a narrowed portion 30 located at a relatively high position. In FIG. 4, reference numeral 31 is an adapter insulator, 32 is a support sleeve made of a hollow metal cylinder, one end of which is secured to one end of the adapter insulator 31 and electrically connected to the rod conductor 9 and the other end of which extends to accommodate and hold the high voltage terminal 8 of the spark plug 7. The support sleeve 32 may be secured to the adapter insulator 31 by press-fit, bonding or insert-molding and may be made of a rigid material. A small gap is formed between the support sleeve 32 and the high voltage terminal 8 of the spark plug 7 and the dimension of the gap is determined in a manner similar to that described and illustrated in conjunction with FIG. 1.

With the plug hole configuration as illustrated in FIG. 4, when the diameter of the rubber cap 22 including the adapter insulator 31 is larger than the inner diameter of the narrowed portion 30 of the plug hole, that portion of the rubber cap 22 cannot be inserted deeper beyond the narrowed portion 30. In order to cope with this, the metallic support sleeve 32 is securely connected to the adapter insulator 31 of which front end cannot otherwise be extended to the spark plug 7 to accommodate and hold the high voltage terminal 8. Therefore, in this embodiment, even when the narrowed portion 30 of the plug hole is located at a relatively high position in the plug hole, the high voltage terminal 8 of the spark plug 7 can be accommodated and held by the support sleeve 32 and the vibration of the adapter assembly 31*a* can be minimized.

Also according to this embodiment, the same, common adapter insulator 31 can be used in different plug holes with various plug hole length. That is, when the plug hole length is different, the support sleeve 32 may be replaced with the one that fits to that particular plug hole length.

Embodiment 5.

Figure 5:
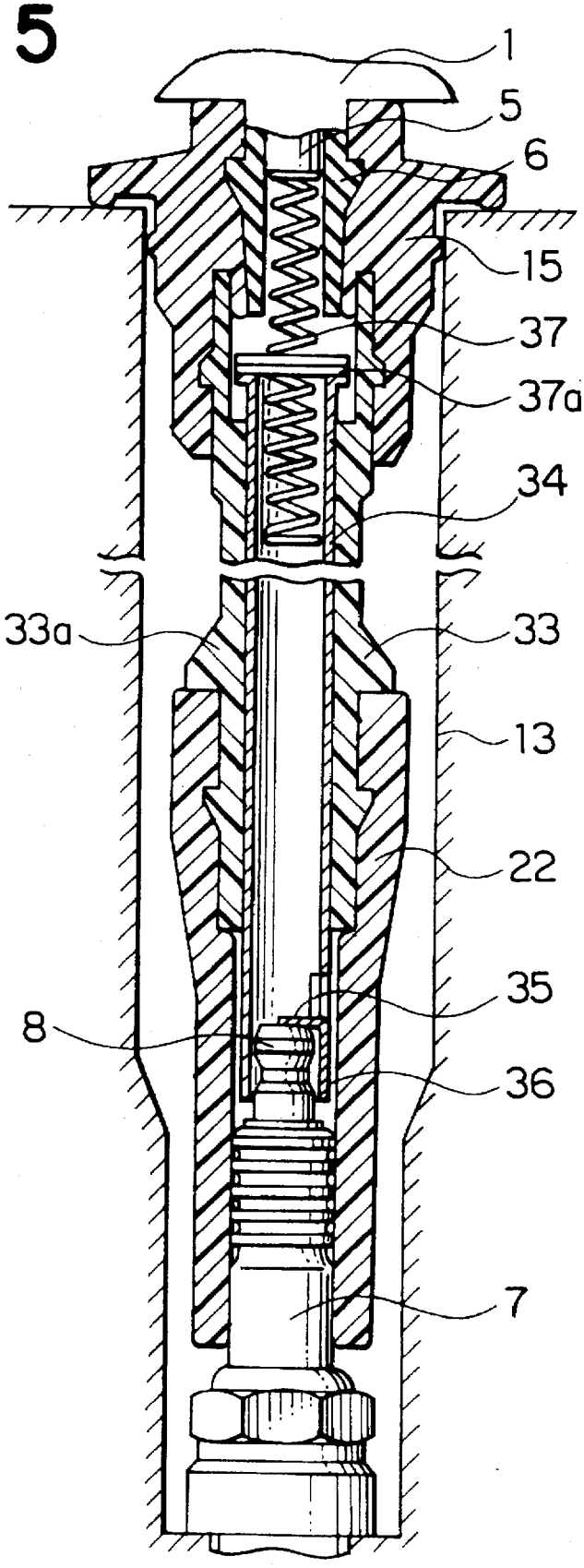
FIG. 5 is a sectional view of the electrical connector of the ignition device of another embodiment of the present invention.

FIG. 5 illustrates a still another embodiment of the electrical connector of the ignition device of the present invention, in which the rod conductor 9 of FIG. 1 is replaced with an electrically conductive metal tube 34 extending through the adapter-insulator 33. The conductive metal tube 34 has at its one end a support sleeve 36. In FIG. 5, reference numeral 33 is an adapter insulator, 34 is the electrically conductive metal tube, 35 is an engaging tab inwardly extending from the support sleeve 36 so that the high voltage terminal 8 of the spark plug 7 abuts and engages against this tab 35 for establishing a good electrical connection therebetween. This engaging tab 35 may be provided by bending a part of the metal wall of the support sleeve 36. The support sleeve 38 accommodates and holds the high voltage terminal 8 of the spark plug 7. Reference numeral 37 is a compression spring disposed between the high voltage terminal 5 of the ignition coil 1 and the conductive metal tube 34, with its large-diameter end 37*a* in engagement with the upper end of the conductive metal tube 34, for establishing an electrical connection therebetween. The compression spring 37 urges the engaging tab 35 against the top of the high voltage terminal 8 of the spark plug 7. It is to be noted that a small gap similar to that of the embodiment described and illustrated in conjunction with FIG. 1 is defined between the support sleeve 36 and the high voltage terminal 8.

Therefore, in this embodiment, the support sleeve 36 accommodates and holds the high voltage terminal 8, so that the vibration of the adapter assembly 33*a* is minimized, and since the hollow conductive metal tube is employed in place of the rod conductor, the weight of the electrical connector can be reduced. Also, since a compression spring is not used at the spark plug side, the number of components is decreased, resulting in the decrease in the manufacturing cost.

Figure 6:
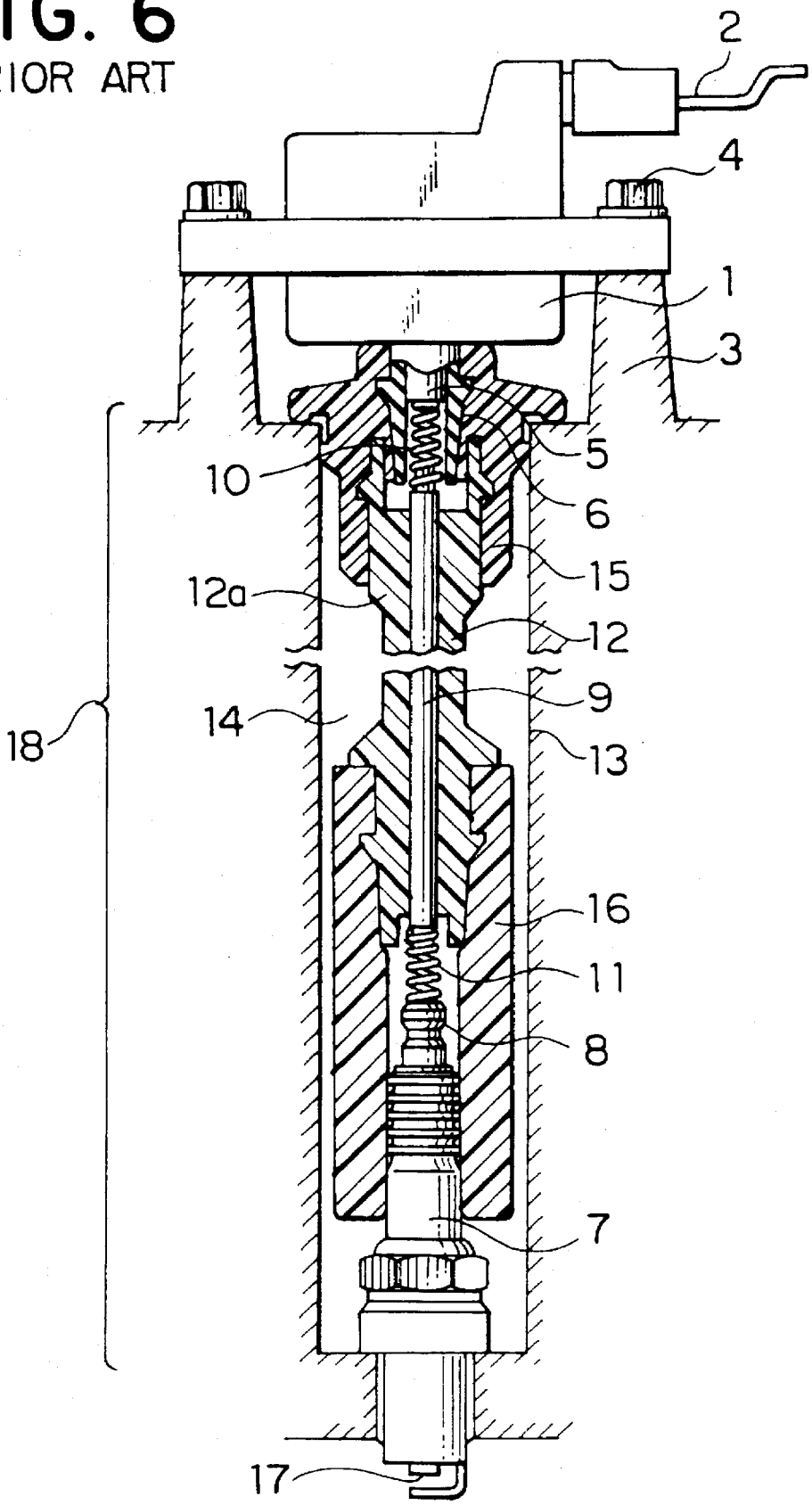
FIG. 6 PRIOR ART
FIG. 6 is a sectional view of a conventional ignition device mounted to an internal combustion engine.
Figure 7:
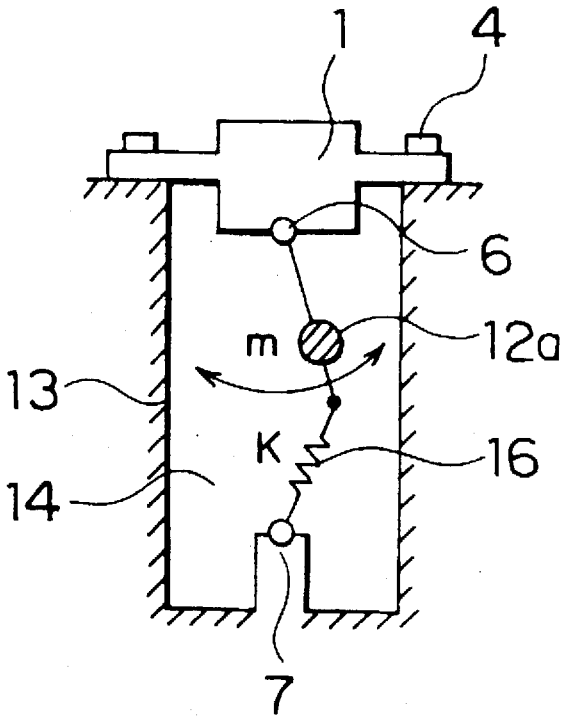
FIG. 7 PRIOR ART
FIG. 7 is a vibration system diagram for explaining the mechanism of vibration of the adapter assembly of the conventional ignition device.

While the spring 37 which has the large-diameter portion 37*a* is used in this embodiment, a simple coil spring similar to the spring 10 shown in FIG. 6 may equally be used with a conductive metal tube having an end of a suitable fitting configuration. Also, a throat or a narrowed portion may be formed in a portion of the conductive metal tube 34 in place of the engaging tab 35.

While the first and the second rubber caps are separate discrete members relative to the adapter insulator in the above various embodiments, they may be an integral, unitary structure made of a single material.

As has been described, according to the ignition device of the present invention, an adapter assembly for electrically connecting an ignition coil to a high voltage terminal of a spark plug comprises a support sleeve disposed to the adapter assembly for accommodating and supporting the high voltage terminal of the spark plug against a transverse movement of the high voltage terminal, so that the vibration of the adapter assembly can be minimized.

The support sleeve may have an inwardly extending projection for establishing an electrical contact with respect to the high voltage terminal of the spark plug, and alternatively, the support sleeve may comprise wear resistive material, such as an elastic member, a metal member or film attached to the inner surface of the sleeve, disposed between the high voltage terminal of the spark plug and an inner surface of the support sleeve, for minimizing wear of the sleeve. Therefore, the ignition device is reliable for a prolonged period of term.

The electrical connector of the present invention for connecting a high voltage terminal of a spark plug of an internal combustion engine to an ignition coil comprises a first electrically insulating cap adapted to be attached to the ignition coil, a second electrically insulating cap adapted to be attached to the spark plug, an electrical insulator attached to the first and Second electrically insulating caps at its opposite ends, and an electrical conductor supported by and extending through the electrical insulator for electrically connecting the ignition coil and the high voltage terminal of the spark plug to each other, and the electrical insulator is provided with a support sleeve disposed thereto for accommodating and supporting the high voltage terminal of the spark plug at its inner surface against a transverse movement of the high voltage terminal. Therefore, the vibration of the electrical connector is minimized and reliable.

What is claimed is:

1. An ignition device for an internal combustion engine, comprising:

a spark plug including a high voltage terminal;

an ignition coil for generating a high voltage to be supplied to said spark plug; and an adapter assembly for electrically connecting said ignition coil to said high voltage terminal of said spark plug;

said adapter assembly having a support sleeve for accommodating and supporting said high voltage terminal of said spark plug;

said support sleeve having an axial length sufficient to receive therein said high voltage terminal including a portion of the base of said high voltage terminal, and being arranged so as to maintain a small clearance between an entire inner peripheral wall of said support sleeve and said high voltage terminal such that transverse movement of said adapter assembly relative to said spark plug is substantially eliminated.

2. An ignition device for an internal combustion engine as claimed in claim 1, wherein said support sleeve comprises a continuous extension of said adapter assembly.

3. An ignition device for an internal combustion engine as claimed in claim 1, wherein said support sleeve comprises an electrically conductive metal tube secured at its one end to said adapter assembly.

4. An ignition device for an internal combustion engine as claimed in claim 3, wherein said adapter assembly and said spark plug are located within a plug hole, and said plug hole has a narrowed portion located at a relatively high position.

5. An ignition device for an internal combustion engine as claimed in claim 1, wherein said adapter assembly comprises an electrically conductive metal tube extending therein, said metal tube having at its one end said support sleeve as an integral, continuous extension thereof.

6. An ignition device for an internal combustion engine as claimed in claim 5, wherein said support sleeve having an inwardly extending projection for establishing an electrical contact with respect to said high voltage terminal of said spark plug.

7. An ignition device for an internal combustion engine as claimed in claim 1, wherein said adapter assembly and said spark plug are located within a plug hole, and an insulator section of said spark plug is located within a section of said plug hole having a reduced diameter.

8. An ignition device for an internal combustion engine, comprising:

a spark plug including a high voltage terminal;

an ignition coil for generating a high voltage to be supplied to said spark plug;

an adapter assembly for electrically connecting said ignition coil to said high voltage terminal of said spark plug;

said adapter assembly having a support sleeve for accommodating and supporting said high voltage terminal of said spark plug; and a cylindrical wear resisting means disposed between said high voltage terminal of said spark plug and an inner peripheral surface of said support sleeve, for minimizing wear of said sleeve;

said support sleeve having an axial length sufficient to receive therein said high voltage terminal including a portion of the base of said high voltage terminal, and being arranged so as to maintain a small clearance between an entire inner peripheral wall of said cylindrical member and said high voltage terminal such that transverse movement of said adapter assembly relative to said spark plug is substantially eliminated.

9. An ignition device for an internal combustion engine as claimed in claim 8, wherein said wear resisting means is comprised of elastic.

10. An ignition device for an internal combustion engine as claimed in claim 8, wherein said wear resisting means is comprised of metal, and is attached to said inner peripheral surface of said sleeve.

11. An ignition device for an internal combustion engine as claimed in claim 8, wherein said wear resisting means is comprised of a metal film, and is attached to said inner peripheral surface of said sleeve.

12. An electrical connector for connecting a high voltage terminal of a spark plug of an internal combustion engine to an ignition coil, comprising:

a first electrically insulating cap adapted to be attached to the ignition coil;

a second electrically insulating cap adapted to be attached to the spark plug;

an electrical insulator attached to the first and second electrically insulating caps at its opposite ends; and an electrical conductor supported by and extending through said electrical insulator for electrically connected the ignition coil and the high voltage terminal of the spark plug to each other;

said electrical insulator having a support sleeve disposed thereto for accommodating and supporting the high voltage terminal of the spark plug at its inner surface;

the support sleeve having an axial length sufficient to receive therein a portion of the base of said high voltage terminal, and being arranged so as to maintain a small clearance between all an entire inner peripheral wall of the support sleeve and an entire outer peripheral surface of said high voltage terminal such that transverse movement of the adapter assembly relative to the spark plug is substantially eliminated.

13. An electrical connector as claimed in claim 12, wherein said electrical conductor including a conductor rod and a compression spring inserted between said conductor rod and the high voltage terminal of the spark plug.

14. An electrical connector as claimed in claim 12, wherein the high voltage terminal of the spark plug and one end of said electrical conductor connected to said high voltage terminal are accommodated within said support sleeve which is supported within said second electrically insulating cap.

15. An ignition device for an internal combustion engine, comprising:

a spark plug including a high voltage terminal;

an ignition coil for generating a high voltage to be supplied to said spark plug; and an adapter assembly for electrically connecting said ignition coil to said high voltage terminal of said spark plug;

said adapter assembly having a support sleeve for accommodating and supporting said high voltage terminal of said spark plug against a transverse movement of said high voltage terminal;

wherein said support sleeve comprises wear resisting means, disposed between said high voltage terminal of said spark plug and an inner surface of said support sleeve, for minimizing wear of said sleeve; and wherein said wear resisting means comprises a metal film member attached to said inner surface of said sleeve.

16. An ignition device for an internal combustion engine, comprising:

a spark plug including a high voltage terminal;

an ignition coil for generating a high voltage to be supplied to said spark plug;

an adapter assembly for electrically connecting said ignition coil to said high voltage terminal of said spark plug;

said adapter assembly having a support sleeve for accommodating and supporting said high voltage terminal of said spark plug; and a rubber cap surrounding said adapter assembly;

said cap having a cylindrical rubber wear resisting means, continuously extending inwardly from said cap so as to be interposed between said high voltage terminal and said support sleeve, for minimizing wear of said sleeve;

wherein said support sleeve grasps said high voltage terminal through said cylindrical rubber wear resisting means.

* * * * *